US011225863B2

(12) United States Patent
Han et al.

(10) Patent No.: US 11,225,863 B2
(45) Date of Patent: Jan. 18, 2022

(54) METHOD FOR CONTROLLING A DRILLING SYSTEM

(71) Applicant: China Petroleum & Chemical Corporation, Beijing (CN)

(72) Inventors: Jun Han, Houston, TX (US); Sheng Zhan, Houston, TX (US); Fengtao Hu, Houston, TX (US); Jinhai Zhao, Houston, TX (US)

(73) Assignee: China Petroleum & Chemical Corporation, Beijing (CN)

( * ) Notice: Subject to any disclaimer, the term of this patent is extended or adjusted under 35 U.S.C. 154(b) by 0 days.

(21) Appl. No.: 16/946,928

(22) Filed: Jul. 11, 2020

(65) Prior Publication Data

US 2020/0340355 A1 Oct. 29, 2020

Related U.S. Application Data

(63) Continuation of application No. 15/983,924, filed on May 18, 2018, now Pat. No. 10,738,598.

(51) Int. Cl.

| | |
|---|---|
| ***E21B 47/18*** | (2012.01) |
| ***E21B 44/00*** | (2006.01) |
| ***E21B 47/24*** | (2012.01) |

(52) U.S. Cl.

CPC ..... *E21B 47/18* (2013.01); *E21B 44/005* (2013.01); *E21B 47/24* (2020.05)

(58) Field of Classification Search

CPC ..... E21B 21/12; E21B 47/24; E21B 49/005; E21B 44/005; E21B 47/18; E21B 47/00

See application file for complete search history.

(56) References Cited

U.S. PATENT DOCUMENTS

| | | | | |
|---|---|---|---|---|
| 3,980,881 | A | 9/1976 | Veach et al. | |
| 6,741,185 | B2 * | 5/2004 | Shi | G01V 11/002 340/853.2 |
| 7,646,310 | B2 | 1/2010 | Close | |
| 9,328,605 | B2 | 5/2016 | Conn | |
| 10,344,590 | B1 | 7/2019 | Young et al. | |
| 2004/0200639 | A1 | 10/2004 | Jungerink | |
| 2013/0080063 | A1 | 3/2013 | Pillai et al. | |
| 2014/0236357 | A1 | 8/2014 | Degrange | |
| 2016/0320520 | A1 | 11/2016 | Hiles et al. | |
| 2017/0016292 | A1 | 1/2017 | Solem | |

(Continued)

FOREIGN PATENT DOCUMENTS

| | | | |
|---|---|---|---|
| CN | 1948708 | A | 4/2007 |
| CN | 101832130 | A | 9/2010 |
| GB | 2407597 | A | 5/2005 |

*Primary Examiner* — Michael R Wills, III

(74) *Attorney, Agent, or Firm* — Novick, Kim & Lee, PLLC; Allen Xue

(57) ABSTRACT

A drilling system that includes a mud pump disposed on an earth surface and a drill string with a bottom hole assembly (BHA) in a borehole. The drilling system can be controlled by turning the mud pump ON or OFF according to a pre-determined sequence so that the mud flow in the borehole fluctuates between high and low. The mud pulser in the bottom hole assembly senses the fluctuation in the mud flow and generates a binary signal accordingly. The mud pulser further sends the binary signal to a measurement-while-drilling (MWD) tool in the bottom hole assembly. The binary signal executes one or more firmware in the MWD tool.

10 Claims, 3 Drawing Sheets

(56) References Cited

U.S. PATENT DOCUMENTS

| | | | |
|---|---|---|---|
| 2017/0306755 | A1 | 10/2017 | Barak |
| 2017/0362933 | A1 | 12/2017 | Jiang et al. |
| 2018/0066513 | A1 | 3/2018 | Sugiura |

* cited by examiner

METHOD FOR CONTROLLING A DRILLING SYSTEM

CROSS-REFERENCE TO RELATED APPLICATION

This application is a continuation application of U.S. application Ser. No. 15/983,924 filed May 18, 2018.

FIELD OF TECHNOLOGY

The present disclosure relates generally to communication systems in drilling operations, and particularly, to systems and methods for generating and transmitting data signals between the earth surface and downhole in gas and oil exploration.

BACKGROUND

Drilling operations in gas and oil exploration involve driving a drill bit into the ground to create a borehole (i.e., a wellbore) from which oil and/or gas are extracted. The drill bit is installed at the distal end of a drill string, which extends from a derrick on the surface into the borehole. The drill string is formed by connected a series of drill pipes together. A bottom hole assembly (BHA) is installed proximately above the drill bit in the drill string.

The BHA contains instruments that collect and/or transmits information regarding the drilling tools, wellbore conditions, earth formation, etc. to the surface. The information is used to determine drilling conditions such as, drift of the drill bit, inclination and azimuth, which in turn are used to calculate the trajectory of the borehole. Real-time data are important in monitoring and controlling the drilling operation, either by automatic control or operator intervention.

Technology for transmitting information within a wellbore, known as telemetry technology, is used to transmit the information from the BHA to the surface for further analysis. One of the known telemetry methods is mud pulse telemetry, which uses drilling mud to carry information from downhole to the surface. Drilling mud, aka drilling fluid, is pumped by a mud pump from surface down the wellbore through the conduit inside the drill string and circulates back to the surface through the annular space between the drill string and the wellbore.

The flow of the drilling mud through the drill string may be modulated (i.e., encoded) by a mud pulser to cause pressure and/or flow rate variations. The pressure or flow rate variations are captured by a corresponding sensor at or near the surface and decoded using a decoding software to recover the downhole information. The mud pulser can be a part of the BHA in a system using mud pulse telemetry.

Specific designs of a mud pulser may vary but the basic principle is that the mud pulser generates pressure pulses by constricting a flow path in the mud flow in the borehole. The mud flow is constricted or released in the drill string with according to a specific timing sequence to encode data in the modulated pressure pulses in the mud flow. The modulated pressure pulses propagate through the mud flow to the surface, which are detected and decoded at the surface to retrieve the original data.

Mud pumps, which provide the motive force to the mud flow, are large positive displacement pumps that drive the mud flow by moving a piston back and forth within a cylinder while simultaneously opening and closing intake and exhaust valves. A typical mud pump has three pistons attached to a common drive shaft. These pistons are one hundred and twenty degrees out of phase with one another to minimize pressure variations. A dampener is used to reduce the pulsation in the mud flow.

In addition to mud pulse telemetry, wired drill pipe telemetry is also frequently used in drilling operations. In wired drill pipe telemetry, the drill pipes in a drill string have communication cable embedded in the drill pipe wall. When the drill pipes are connected together, sections of communication cable form a continuous communication cable from the BHA to the surface along the drill string. The advantage of the wired telemetry is that the data transmission through the cable is bidirectional and is much faster than that of mud pulse telemetry. However, connecting two sections of communication cable at the joint between two drill pipes requires sophisticated and expensive coupling devices. When drilling a deep well, many of such joints are needed. Breakage of the communicate cable at any of the joints would disable the telemetry, which requires expensive repairs. For this and other reasons, mud pulse telemetry is still widely used in drilling operations nowadays.

Differing from bidirectional wired telemetry, the mud pulse telemetry normally telemeters data from downhole to the surface. There is a need for methods and systems that telemeter signals from the surface to tools in the borehole downhole.

SUMMARY

The present disclosure provides a method for operating a drilling system that has a mud pump disposed on an earth surface and a drill string with a bottom hole assembly (BHA) in a borehole. In one embodiment, the method involves turning the mud pump ON or OFF according to a pre-determined sequence to cause a mud flow in the borehole to fluctuate in response to the pre-determined sequence. The mud flow in the borehole fluctuates between high flow rates and low flow rates, including substantially zero flow rate. The mud pulser in the bottom hole assembly senses the fluctuations in the mud flow and generates a binary signal accordingly. The mud pulser then sends the binary signal to a measurement-while-drilling (MWD) tool in the bottom hole assembly. The binary signal executes one or more firmware in the MWD tool.

In some embodiments of the current disclosure, the binary signal is encoded with a command and the MWD tool detects and decodes the binary signal to obtain the command. The command identifies one of the one or more firmware for execution.

In other embodiments, the MWD tool comprises one or more memory, a microprocessor, and input/output communication ports that interface with the mud pulser. The one or more firmware is stored on the one or more memory and executed by the microprocessor. The memory can be any non-volatile memory.

The one or more firmware disclosed herein includes a front firmware and one or more task firmware. The front firmware selects one of the one or more task firmware for execution at a time while each task firmware operates a plurality of sensors in the MWD tool under a different set of conditions.

In still other embodiments, the task firmware controls certain parameters of the MWD tool, which may include the number of sensors, the data sampling frequency, the data logging frequency, the amount of data being transmitted to the surface, the amount of data being stored locally on the MWD tool, etc.

The mud pulser disclosed herein includes one or more flow sensors that senses the mud flow, determines a state of the mud flow as ON or OFF, and outputs the binary signal to the MWD tool.

This disclosure further provides a method for controlling a MWD tool in a bottom hole assembly in a borehole. In this method, a plurality of firmware are installed in the MWD tool. The plurality of firmware are pre-programmed to perform a plurality of tasks. The mud pump on an earth surface is turned ON or OFF according to a pre-determined sequence. The mud flow in the borehole fluctuates in response to the mud pump and is determined to be ON or OFF so as to form a binary signal. The binary signal is sent to the MWD tool.

The ON or OFF state of the mud flow is determined by a mud flow sensor in a mud pulser and the mud flow sensor driver circuit outputs the binary signal to the MWD tool.

This disclosure further provides a method for high temperature drilling. The method includes installing a plurality of firmware in a MWD tool in a bottom hole assembly in a drill string. The temperature in the borehole increases as its depth increases. The maximum temperature of the bottom hole assembly in the borehole can range from 100° C. to 200° C. or higher. One of the firmware is executed when the temperature is at or below a first threshold, e.g., 120° C. or 150° C. A different firmware is executed when the temperature of the bottom hole assembly exceeds a second threshold, e.g., 180° C. or 200° C. There are optionally one more firmware that are executed at the temperature between the first threshold and the second threshold.

Switching from executing one firmware to executing another firmware is accomplished by turning ON or OFF a mud pump according to a pre-programmed sequence. In doing so, the mud flow can be encoded with one or more command signals, i.e., flow commands. The MWD tool receives the flow command and executes the corresponding task according to the flow command.

BRIEF DESCRIPTION OF THE DRAWINGS

For a more complete understanding of the embodiments described in this disclosure, reference is made to the following detailed description taken in conjunction with the accompanying drawings, in which.

DETAILED DESCRIPTION

Reference will now be made in detail to several embodiments of the present disclosure(s), examples of which are illustrated in the accompanying figures. It is noted that wherever practicable similar or like reference numbers may be used in the figures and may indicate similar or like functionality. The figures depict embodiments of the present disclosure for purposes of illustration only. One skilled in the art will readily recognize from the following description that alternative embodiments of the structures and methods illustrated herein may be employed without departing from the principles of the disclosure described herein.

Figure 1:
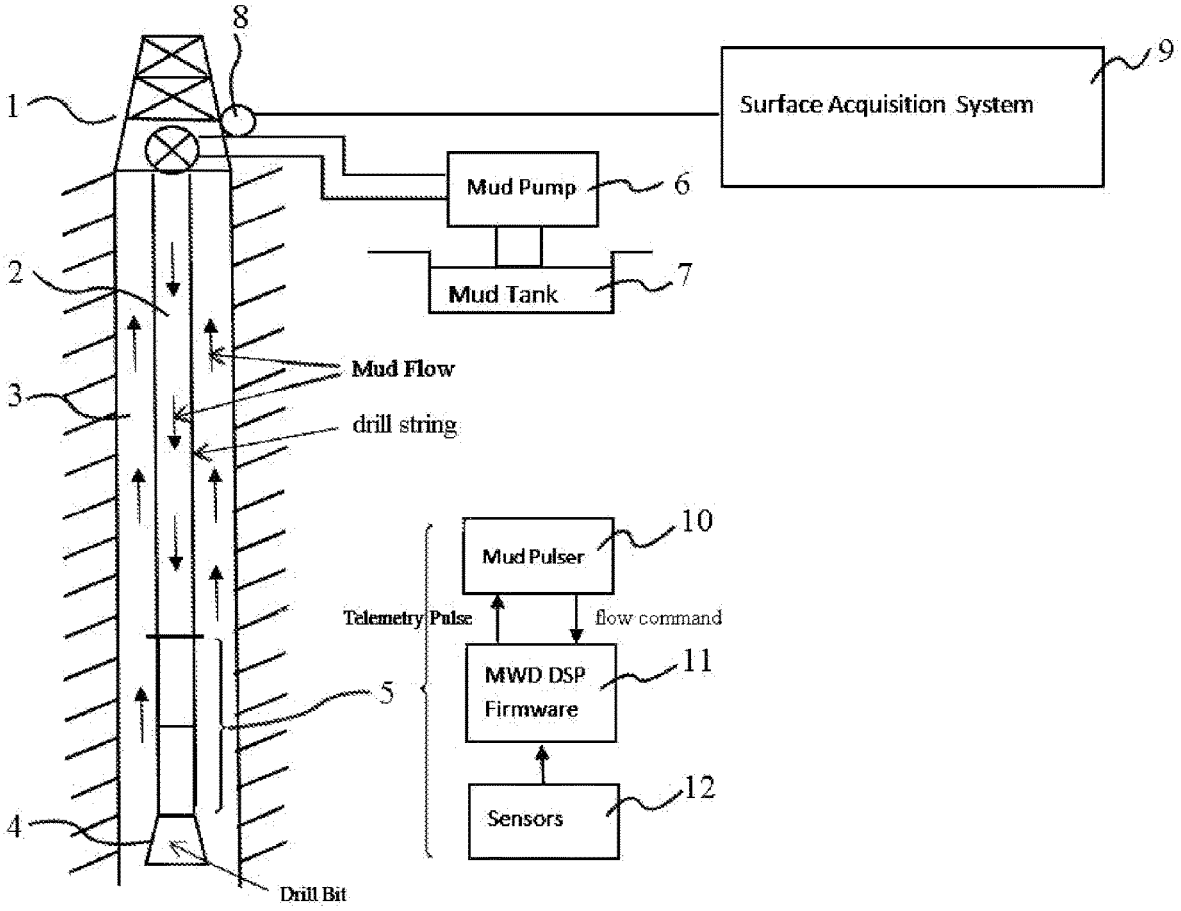
FIG. 1 is a schematic illustration of a drilling rig of the current disclosure.

FIG. 1 schematically illustrates a drilling operation. The drill string 2 extends from the derrick 1 on the surface into the borehole 3. The drill bit 4 is installed at the distal end of the drill string 2. The BHA 5 is installed above the drill bit 4. The mud pump 6 pumps the mud flow from the mud tank 7 downhole through the drill string 1. The mud flow circulates back to the mud tank 7 via the annulus between the drill string 1 and the borehole 3.

The BHA 5 includes a mud pulser 10, a mud motor (not shown), a measurement-while-drilling (MWD) instruments (not shown), and logging-while-drilling (LWD) instruments (not shown). In this disclosure, the MWD instruments and LWD instruments are collectively referred to as the MWD tool. The MWD tool is powered by the mud motor, the battery, or both the mud motor and the battery (not shown). The MWD tool has one or more internal memory, a microprocessor, software and/or firmware with pre-programmed instructions installed on the memory, and input/output communication ports for communications with other tools in the BHA, e.g., a mud pulser. The firmware controls the operation of the MWD tools, e.g., controlling the operation of the sensors.

The mud pulser 10 is in communication with a MWD digital signal processor (DSP) 11. The MWD DSP 11 is connected to a plurality of measurement sensors 12 that measure earth formation information and/or directional information, including gamma ray detectors that measure naturally occurring gamma ray in the formation, directional sensors that monitor inclination and azimuth, etc. The MWD DSP 11 sends encoded commands to the mud pulser 10, which in turn generates pressure pulses that propagates uphole. The pressure transducer 8 is installed in the mud flow passage and detects the pressure pulses. It sends the mud pulse signals to the surface data acquisition system 9, which then decodes the pressure pulse signals to obtain information downhole.

In the embodiment of FIG. 1, the mud pulser 10 includes a pulser driver (not shown), which controls the mechanism that restricts or opens the mud flow passage, such as a solenoid valve or a oscillating shear valve (not shown). The pulser may also include a flow sensor (not shown) that detects the mud flow. In one embodiment, the flow sensor has one or more vibration sensitive devices, such as accelerometers. The flow sensor determines whether the drilling mud is flowing or not based on the acceleration force on the accelerometers and output a binary signal. As a result, the modulated mud flow carries the binary signal, which in turn carries commands from the surface down the borehole.

The flow sensor circuit (not shown) may include a memory, a microprocessor, and input/output communication ports that interface with the MWD DSP firmware and/or with other tools in the BHA. In the embodiment of FIG. 1, the MWD DSP firmware controls the mud pulser 10 and is stored in an onboard memory and run by a microprocessor. The flow sensor circuitry may be located on the same printed circuit board that the pulser driver circuitry is located. Independent from the control signal from the MWD tool to the mud pulser 10, the flow sensor circuit determines the ON or OFF state of the mud flow and sends the binary signal to MWD DSP accordingly.

Figure 2:
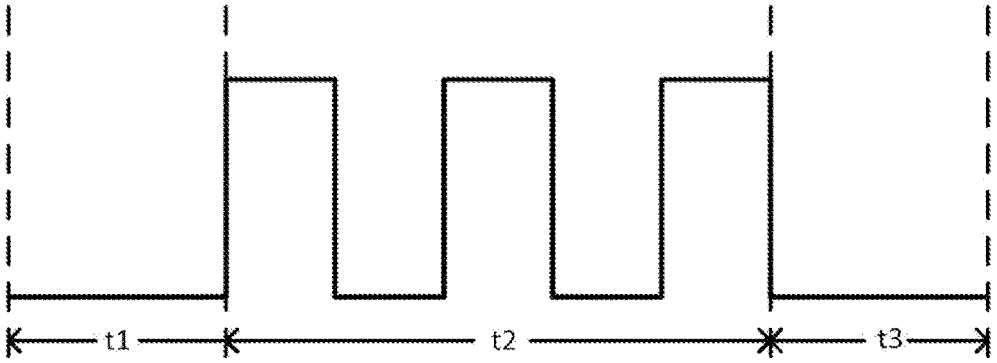
FIG. 2 is an exemplary encoded wave form of the mud flow.

FIG. 2 shows an exemplary mud flow binary signal output from the flow sensor. It defines an initial OFF time t1 followed by three ON periods within a time period of t2, which in turn is followed by another OFF period t3. This combination of binary signals is used as a command signal to the MWD tool and executes the firmware installed in the memory in the MWD tool. Various combinations of such ON and OFF periods during specific time intervals constitute different flow commands. For example, the command signal of FIG. 2 can be a flow command that initiate a switch between different tasks, i.e., a command to execute certain firmware installed in the MWD tool. More details are provided later in this disclosure.

Figure 3:
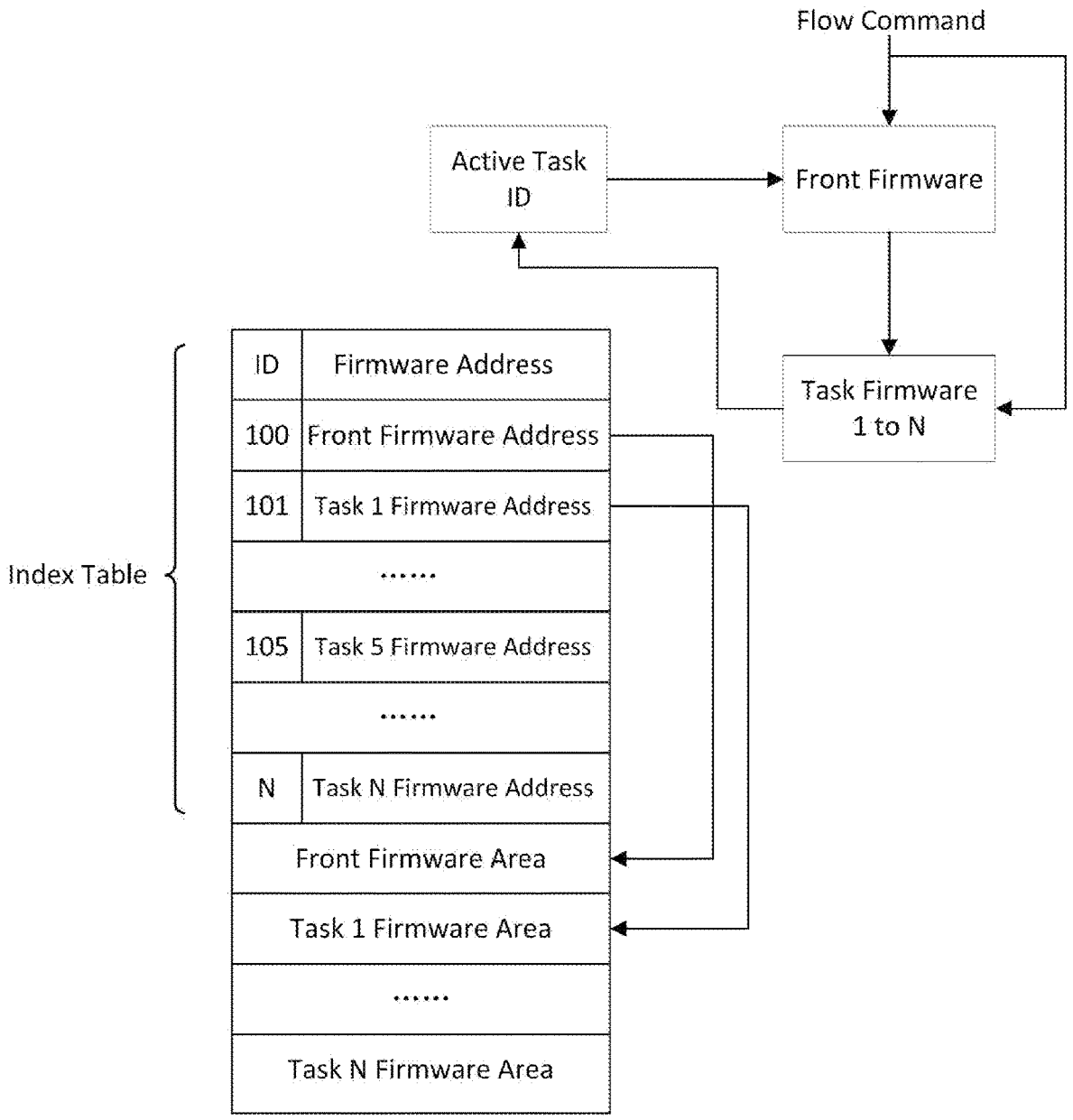
FIG. 3 is a schematic diagram showing functional blocks and the data structure of the firmware embedded on the MWD tool.
Figure 4:
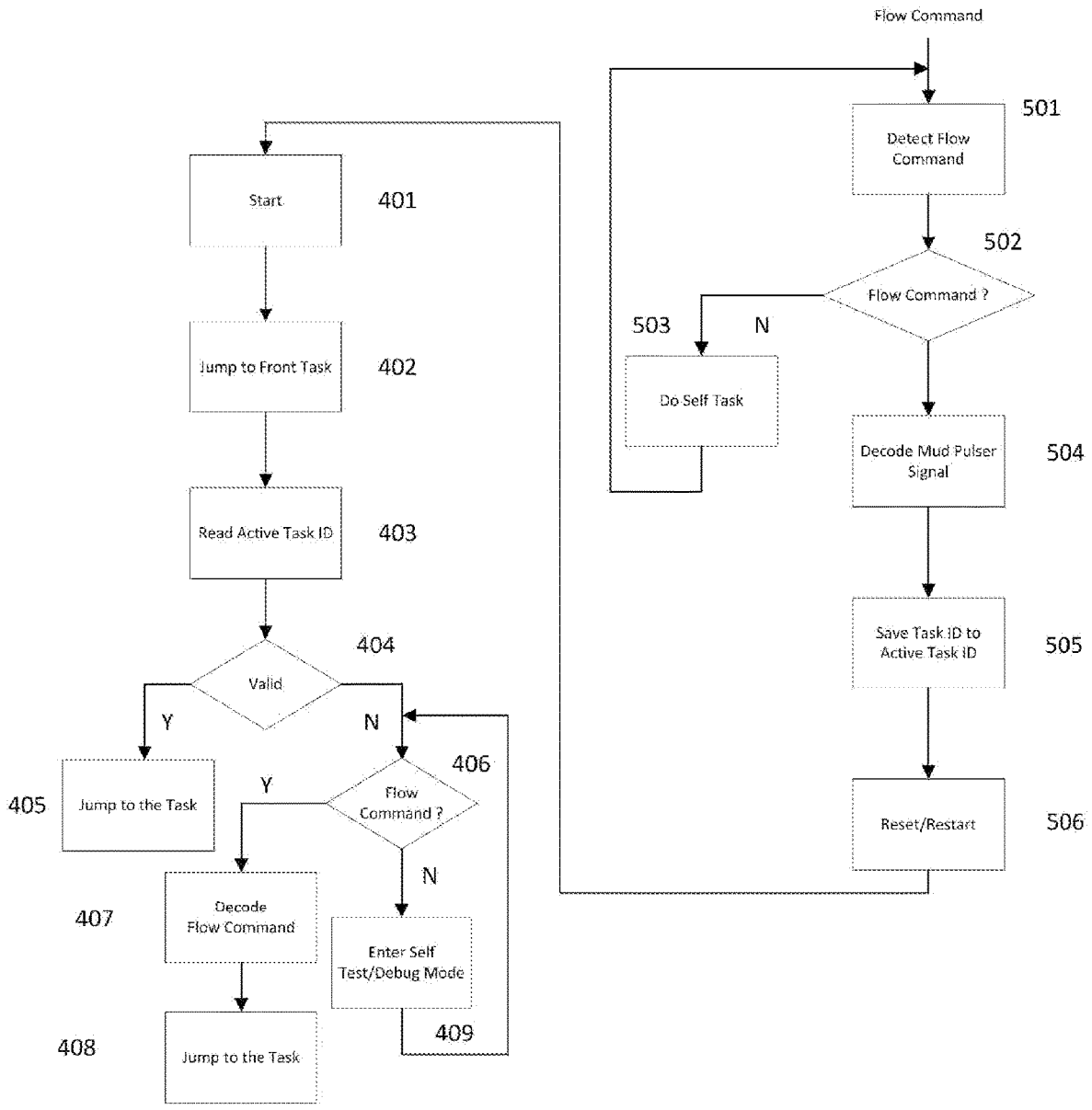
FIG. 4 is a schematic flow diagram showing the execution of the firmware in the MWD tool.

FIGS. 3 and 4 illustrate the firmware in the MWD system and execution of the firmware. As shown in FIG. 3, there is a front firmware and multiple task firmware (Task Firmware 1 to Task Firmware N) stored in a non-volatile memory such as ROM, EPRROM, or flash memory in the MWD system. The firmware can be saved on different sections of a same memory in a microprocessor or on different interconnected memory throughout the MWD tool. The front firmware and task firmware can receive and/or to decode the command signals from the mud pulser, i.e., flow commands. The front firmware determines which specific task the flow command is directed to while the task firmware executes specific tasks (e.g., for low temperature operation vs. for high temperature operation).

FIG. 3 also shows the data structure in the memory, which includes an index table containing IDs and addresses for the front firmware and the task firmware, with pointers to the sections of memory where the corresponding firmware is saved on. The index table may be a part of the front firmware, which determines the task to be executed (i.e., the active task) and determines its active task ID. The active task ID identifies the address of the specific task amongst Tasks 1 to N (Firmware Address) and points to the section of the memory where the code for the corresponding task is saved on (Firmware Area) and executes the code.

The active task can be an active task currently running or an active task prior to the system is powered off or reset. In one embodiment, the active task ID is saved in the memory. When the flow commend does not command changing tasks, the front firmware reads the active task ID and selects the corresponding task firmware amongst task firmware 1 to N. The front firmware then enters a sleep mode. When the flow command requests changing the active task, e.g., from task 1 to task 2, the front firmware initiates a process to accomplish the switch.

In one embodiment, the front firmware distributes tasks to various task firmware. It may be in a sleep mode when the task firmware is running. When the flow command demands a switch, the currently running task firmware initiates a reset to start the front firmware so the front firmware can assign a task to a different task firmware.

Further details of the operation are provided with reference to FIG. 4, which is a simplified flow chart showing an embodiment of the method to execute the front firmware and the task firmware. As shown in FIG. 4, the front firmware is started in step 401 and run the front task in step 402, and reads the active task ID currently written in the active task ID memory (step 403). In step 404, the front firmware determines whether the active task ID is valid or not. If valid, the front firmware finds the address of the corresponding task firmware and from there finds the corresponding task firmware area to execute the task firmware (step 405). If the active ID is invalid, the front firmware reads the flow command (step 406). If the flow command is valid (a flow command that matches a preset sequence of signals), the front firmware decodes the flow command and determines the content of the flow command (step 407). Once the flow command is decoded, the front firmware assigns the corresponding task and executes the corresponding task firmware (step 408). If the flow command is invalid, the front firmware enters a "self test/debug" mode (step 409) and returns to read the flow command.

During normal operation, one of the task firmware is being executed. When a different task is required, a flow command (such as the one shown in FIG. 2) is sent to the front firmware and the task firmware to announce that a switching of task firmware is pending. Afterwards, a second flow command is sent to the MWD tool to announce which new task is being switched to. In this process, the task firmware detects the flow command (step 501) and determine whether the flow command is valid or not (step 502). If the flow command is not valid, the task firmware continues to run the current task and monitors the flow command until it receives a valid flow command (step 503). Once it is determined that the flow command is valid, the task firmware decodes the flow command (step 504) to obtain the ID of the task being switched to, writes the new task ID as the active ID in the memory (step 505), and then restarts the microprocessor to terminate the current task and hand over the control to the front firmware (step 506).

In some embodiments of this disclosure, exemplary tasks run by task firmware are related to the downhole conditions, such as temperature and pressure in the borehole. For example, Task 1 is designated to run a plurality of sensors at a temperature at or below a certain temperature, e.g., 120° C. or 150° C. The sensors can be for temperature, pressure, flow rate, azimuth, inclination, total H field, total G field, dip angle, etc. Task 1 defines conditions such as which sensors are running, the sampling frequency, data logging frequency, data being transmitting to the surface in real time, data being stored in an internal memory, etc. Task 2 is activated when the downhole temperature each a threshold, e.g., 180° C. Task 2 may change the type, the number, and/or the location of the sensors from Task 1, as well as the other conditions of the sensors. When the downhole temperature surpasses 200° C., Task 2 is switched to Task 3, which executes another set of conditions.

The changing of the task may be initiated by an operator who monitors the downhole temperature. When the temperature reaches a threshold level, the operator turns the mud pump ON or OFF according to a certain sequence to encode the mud flow with the appropriate flow command that switches the active task from Task 1 to Task to or from Task 2 to Task 3.

In other embodiments, the system can be used to test different versions of a task firmware. In one such example, two different versions of the firmware written for Task 3 for operation at or above 200° C. can be installed in the MWD tool. During the drilling operation, the operator can manipulate the mud pump to switch from one version of the firmware to another, while the BHA remain in the bottomhole, avoiding the expensive tripping operation.

Additional scenarios when switching tasks is needed include the status of the battery pack (e.g., fully charged vs. exhausted), the status of formation (relatively uniform formation vs. fast changing formation). The former requires adjusting sensor conditions (e.g., number of sensors, sampling frequency) to reduce power consumption while the latter may require increasing the sampling frequency.

While in the foregoing specification this disclosure has been described in relation to certain preferred embodiments thereof, and many details have been set forth for purpose of illustration, it will be apparent to those skilled in the art that the disclosure is susceptible to alteration and that certain other details described herein can vary considerably without departing from the basic principles of the disclosure. In addition, it should be appreciated that structural features or method steps shown or described in any one embodiment herein can be used in other embodiments as well.

What is claimed is:

1. A method for operating a drilling system, wherein the drilling system comprises a mud pump disposed on an earth surface, and a drill string with a bottom hole assembly (BHA) in a borehole, the method comprising:

turning the mud pump ON or OFF according to a pre-determined sequence to cause a mud flow in the borehole to fluctuate in response to the pre-determined sequence;

sensing the mud flow in the borehole using a mud pulser in the bottom hole assembly to generate a binary signal; and sending the binary signal to a measurement-while-drilling (MWD) tool in the BHA, wherein the binary signal is encoded with a command and the MWD tool detects and decodes the binary signal to obtain the command, wherein the MWD tool comprises a front firmware and one or more task firmware, wherein each of the one or more task firmware operates a plurality of sensors in the MWD tool under a set of conditions, and wherein the front firmware receives the command and selects one of the one or more task firmware to execute the command.

2. The method of claim 1, wherein the MWD tool comprises one or more memory, a microprocessor, and an interface with the mud pulser, wherein the one or more firmware is stored on the one or more memory and executed by the microprocessor.

3. The method of claim 1, wherein the plurality of sensors monitor one or more drilling conditions chosen from temperature, pressure, flow rate, azimuth, inclination, total H field, total G field, or dip angle.

4. The method of claim 1, wherein the unique set of conditions comprises one or more parameters chosen from a number of sensors in operation, a data sampling frequency, a data logging frequency, data being transmitted to the surface, or data being stored locally on the MWD tool.

5. The method of claim 1, wherein the mud pulser comprises one or more flow sensors that sense the mud flow, determines a state of the mud flow as ON or OFF, and output the binary signal to the MWD tool.

6. The method of claim 1, wherein the first task firmware is executed when a temperature in the borehole equals or is lower than a first threshold; and the second task firmware is executed when the temperature in the borehole equals or is higher than a second threshold.

7. The method of claim 6, wherein the first threshold is 120° C.

8. The method of claim 6, wherein the first threshold is 150° C.

9. The method of claim 6, wherein the second threshold is 180° C.

10. The method of claim 6, wherein the second threshold is 200° C.

* * * * *